United States Patent [19]

Herrmann et al.

[11] 4,265,568

[45] May 5, 1981

[54] GRAVITY BASE, JACK-UP PLATFORM - METHOD AND APPARATUS

[75] Inventors: Robert P. Herrmann; Floyd T. Pease, both of London, England; Donald R. Ray, Houston, Tex.

[73] Assignee: The Offshore Company, Houston, Tex.

[21] Appl. No.: 64,264

[22] Filed: Aug. 6, 1979

[51] Int. Cl.[3] ..... E02B 17/08

[52] U.S. Cl. ..... 405/196; 405/208; 405/224

[58] Field of Search ..... 405/196, 197, 198, 199, 405/200, 205, 207, 208, 224

[56] References Cited

U.S. PATENT DOCUMENTS

| | | | |
|---|---|---|---|
| 2,941,369 | 6/1960 | Quirin | 405/200 |
| 3,062,014 | 11/1962 | Newcomb | 405/205 |
| 3,241,324 | 3/1966 | Storm et al. | 405/196 |
| 3,996,754 | 12/1976 | Lowery | 405/197 |
| 4,007,598 | 2/1977 | Tax | 405/200 |
| 4,043,138 | 8/1977 | Stageboe | 405/205 |

FOREIGN PATENT DOCUMENTS 991247 5/1965 United Kingdom .

OTHER PUBLICATIONS

"New Concepts on Platforms for Deep Water", *Ocean Industry*, Sep. 1972.

"Developers Say New Type Platform Looks Good", *Ocean Industry*, Mar. 1973.

"Gravity Platform Designed to Reduce Offshore Costs", *World Oil*, Nov. 1973.

"New Platform Makes Well Slanting Simple", *Ocean Industry*, May 1976.

"Upright Steel Gravity Platform is Towed to Field Off Congo", *Ocean Industry*, May 1976.

*Primary Examiner*—David H. Corbin

*Attorney, Agent, or Firm*—Bradford E. Kile

[57] ABSTRACT

The invention relates to an offshore, gravity base, jack-up platform comprising a deck, a gravity base and one or more legs interconnecting the deck and base. The gravity base comprises a generally polygonal shaped, monolithic hull structure with reaction members extending downwardly from the hull to penetrate the waterbed and react to vertical and lateral loads imposed upon the platform while maintaining the gravity hull in a posture elevated above the surface of the waterbed.

A method aspect of the invention includes the steps of towing a gravity base, jack-up platform, as a unit, to a preselected offshore site floating upon the gravity hull. During the towing operation, the deck is mounted adjacent the gravity base with a leg or legs projecting through the deck. At a preselected offshore station ballast is added to the gravity base and the platform descends slightly to a posture where the platform is buoyantly supported by the deck. The base is then jacked down toward the seabed and the platform is laterally brought onto station. Ballast is then added to the deck and the reaction members are penetrated into the waterbed to operational soil refusal. Ballast is then ejected from the deck and the deck is jacked to an operational elevation above a predetermined statistical wave crest height.

16 Claims, 21 Drawing Figures

74
20
84
72
75
76
84
73
80
22
86
78
84
78
82
26
30
24
28
30
30

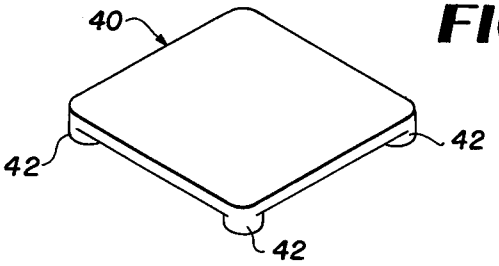
FIG. 4
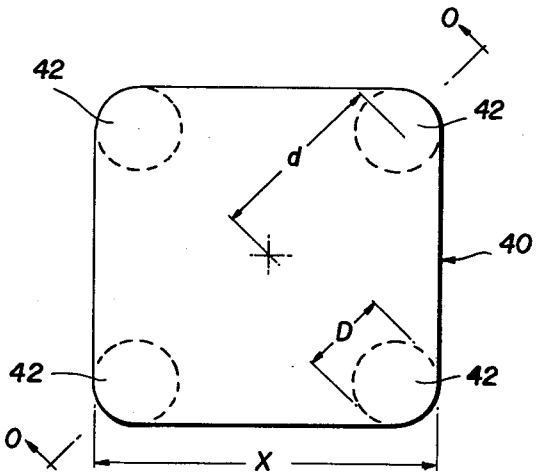
FIG. 5
FIG. 3
FLAT BASE
CIRCULAR MAT
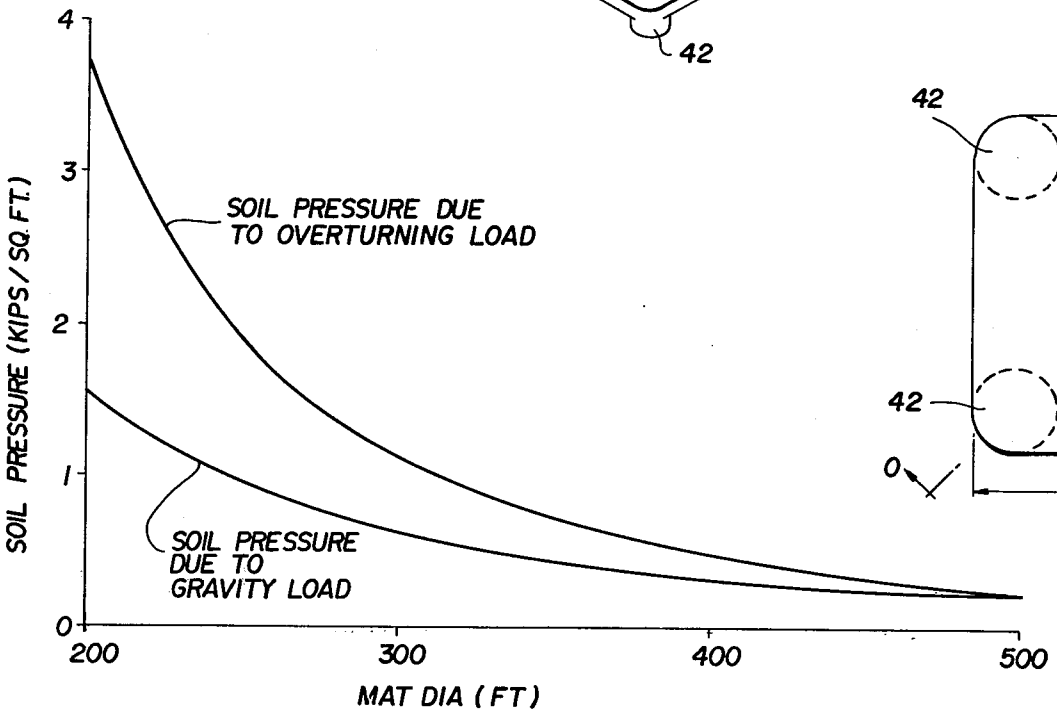

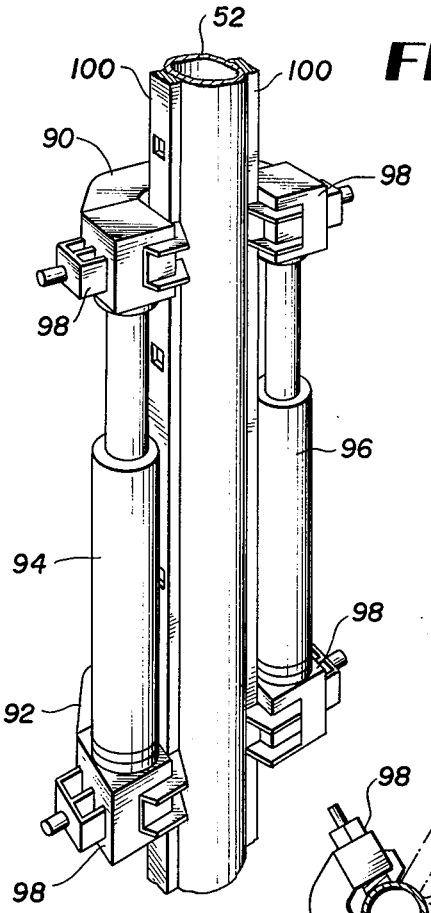
FIG. 9
FIG. 10
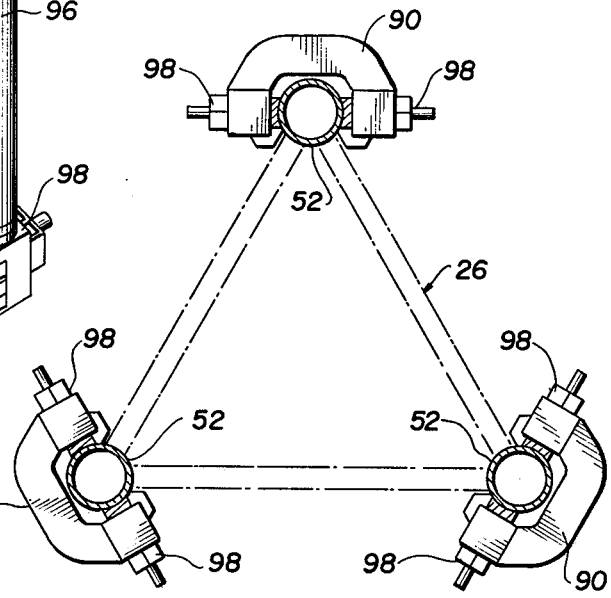
FIG. 11a
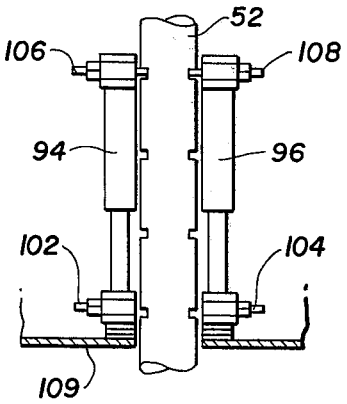
FIG. 11b
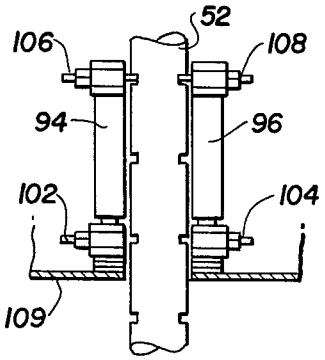

FIG.12a
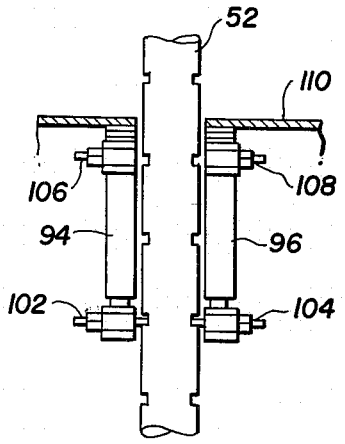
FIG.12b
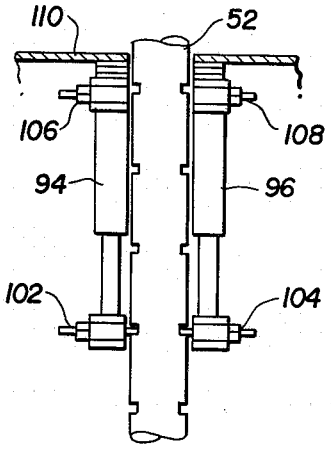
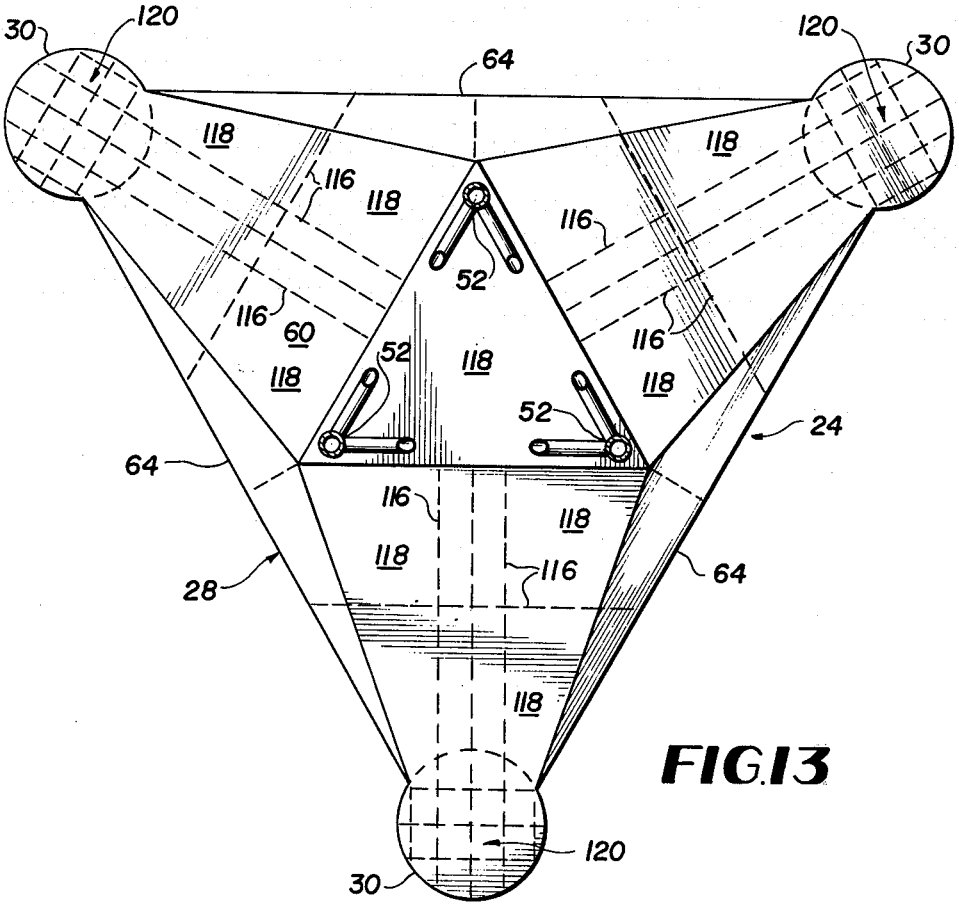
FIG.13

GRAVITY BASE, JACK-UP PLATFORM - METHOD AND APPARATUS

BACKGROUND OF THE INVENTION

This invention relates to a novel offshore platform apparatus and a method for transporting and stationing the same upon the bed of a body of water.

In the past, offshore platforms or towers have been extensively utilized around and upon the continental shelf regions of the world. Examples of offshore platform installations include supports for radar stations, light beacons, scientific and exploration laboratories, chemical plants, power generating plants, etc. Principally, however, offshore platforms have been used by the oil and gas industry in connection with oil and gas drilling, production and distribution operations.

While initial oil and gas operations were conducted along the near shore portions of the Gulf of Mexico, in relatively shallow water depths ranging from swamp or marsh land to 100 or more feet of water, more recent activity has extended to greater water depths of from a few hundred to a thousand or more feet. As deeper water fields are explored and developed, platforms have become larger and environmental loading has become exacerbated. Moreover, production platforms, and in some instances drilling units as well, remain on station for indefinite periods of time and thus encounter prolonged, high stress, periodic wave loading. Accordingly, not only must platforms be capable of withstanding ocean storm conditions; but, minimizing fatigue failure constitutes a significant design consideration.

The foundation of conventional, fixed, offshore structures may be broadly classified in two categories: (1) pile support structures and (2) gravity base structures.

A pile supported structure is one that is attached to the seabed by means of piling driven into the sea floor to support the tower and resist environmental side loading which tends to overturn the structure. Gravity base structures are designed to remain on location strictly because the weight of the structure imposes sufficient loading on the seabed to render the structure safe from sliding or overturning. Gravity base structures do not require pilings and the formation is normally referred to as a mat.

The subject invention is directed to a gravity base platform and a method for facilely constructing, transporting, and stationing the platform upon the bed of a body of water.

One previously known gravity base tower design comprises a concrete platform which was engineered to be installed in the North Sea. In this regard, generally massive concrete structures were utilized to prevent overturning moments from creating an uplift situation on one edge of the base. While concrete designs may solve overturning difficulties, such units are typically bulky, extremely heavy, and difficult to bring on station and reposition if desired.

The mobility of gravity base towers was significantly enhanced by the development of a platform having a generally open tubular superstructure including a base region with caissons secured at peripheral points about the base of the tower. These units were designed to be floated out to a site on the caissons. The caissons would then be controllably flooded to lower the tower to a drilling or production station. Once drilling or production was completed, ballast would be ejected from the caissons and the tower would be buoyantly raised for towing to another site.

Although peripherally stationed caissons may be sufficient to raise and lower a platform, the afloat stability determines the caisson diameter and the stability requirements during a lowering operation determines the height of the caissons. Additionally, if the platform deck and equipment are mounted on the tower before towing to sea, the center of gravity of the overall structure is raised which compounds the stability problem. On the other hand if the deck and associated equipment are installed at sea, after the platform is set, expensive derrick barges and offshore construction equipment are needed to complete construction. As previously noted the foregoing stability situation dictates caisson design and preempts attention to optimizing soil loading. Still further, such previously known units require a high degree of tubular superstructure to support the caissons. Utilization of a high percentage of tubular structures tends to make construction difficult, specialized and not easily performed at conventional shipyard facilities. Yet further, although open superstructure designs are relatively lightweight, such designs tend to be more flexible than concrete designs and exhibit a higher natural period.

Another previously known gravity base design entails a steel base or hull operable to receive ballast on station. Such units are normally lighter than corresponding concrete designs and easier to tow to a site than a generally open superstructure and caisson type base. As will be discussed more fully below, however, steel mat designs typically require a mat having a large diameter of several hundred feet in order to prevent lateral forces from creating an uplift situation from occuring. Additionally, although the ocean floor is thought of as being generally flat, with such large mats, discontinuities in soil formation may create uneven soil bearing zones.

The difficulties suggested in the preceding are not intended to be exhaustive, but rather are among many which may tend to reduce the effectiveness and owner satisfaction with prior gravity base offshore platform systems. Other noteworthy problems may also exist; however, those presented above should be sufficient to demonstrate that gravity base offshore platform systems appearing in the past will admit to worthwhile improvement.

OBJECTS OF THE INVENTION

It is therefore a general object of the invention to provide a novel, gravity base, offshore platform and method of installation which will obviate or minimize difficulties of the type previously described.

It is a specific object of the invention to provide a novel, gravity base, offshore platform having a generally monolithic gravity mat wherein the size and dead weight of the mat may be significantly reduced while retaining the resistance of the platform to overturning moments.

It is another object of the invention to provide a novel, gravity base, offshore platform with an essentially monolithic gravity base wherein more efficient loading of the waterbed soil may be achieved to prevent environmental loads from overturning the platform.

It is yet another object of the invention to provide a novel, gravity base, offshore platform with an essentially monolithic gravity base which may be facilely utilized for producing a preexisting drilled field.

It is still another object of the invention to provide a gravity base, offshore platform which will minimize the adverse effects of soil discontinuities on platform stability while the platform is on station.

It is a related object of the invention to provide a novel, gravity base, offshore platform which will facilitate retrofitting to accomodate variant seabed soil conditions.

It is a further object of the invention to provide a novel, gravity base, offshore platform with a natural period essentially outside the critical range of energy distribution in the ocean.

It is another object of the invention to provide a novel, gravity base, offshore platform which may be essentially fabricated in a conventional shipyard.

It is still a further object of the invention to provide a novel, gravity base, offshore platform and method of installation wherein the platform may be facilely and stably towed to a preselected site as a unit and thus minimize on site construction and/or assembly operations.

It is yet a further object of the invention to provide a novel, gravity base, offshore platform and method of installation wherein the semi-submerged stability of the tower during maneuvering onto station is enhanced.

It is yet still a further object of the invention to provide a novel, gravity base, offshore platform and method of installation wherein preloading of a gravity base equal to or in excess of full environmental loading may be achieved during installation.

It is additionally an object of the invention to provide a novel, single leg, gravity base, offshore platform and method of installation which will achieve an advantageous loading of the waterbed soil to prevent environmental loads from overturning the platform.

BRIEF SUMMARY OF A PREFERRED EMBODIMENT OF THE INVENTION

A preferred embodiment of the invention which is intended to accomplish at least some of the foregoing objects entails a single leg, gravity base, jack-up platform for offshore drilling and/or production activity including a deck, a gravity base and a single leg having at least three interconnected vertical chords. The gravity base comprises a generally polygonal shaped, monolithic hull structure with reaction members extending downwardly from the hull to penetrate the waterbed and react to vertical and lateral loads imposed on the platform while maintaining the gravity hull vertially elevated above and out of operative load bearing contact with the waterbed.

A method aspect of the invention includes the steps of towing the single leg, gravity base, jack-up platform, as a unit, to a preselected offshore site floating upon the gravity hull. During the towing operation the deck is mounted adjacent the gravity base and the single leg projects upwardly through the deck. At a preselected drilling and/or production site the gravity base is at least partially ballasted and the platform is buoyantly supported by the deck. The base is then jacked down to the waterbed, ballast is added to the deck and the reaction members are penetrated into the waterbed to operational refusal. The deck is then deballasted and jacked to an operational elevation above a predetermined statistical wave crest height.

THE DRAWINGS

Other objects an advantages of the present invention will become apparent from the following detailed description of preferred embodiments thereof taken in conjunction with the accompanying drawings, wherein:

FIG. 3 is a graphic representation pertaining to a flat base circular mat depicting a relationship of soil pressure due to gravity loading and overturning moments for a platform such as shown in FIG. 2;

FIG. 4 is an axonometric view of a mathematical model of the subject gravity base invention;

FIG. 5 is a plan view of the mathematical model for the gravity base depicted in FIG. 4;

FIG. 9 is an axonometric view of an illustrative jacking mechanism operable to vertically jack the deck up and down along the single leg of the offshore platform;

FIG. 10 is a plan view of an illustrative jacking system wherein jacking mechanisms, as depicted in FIG. 9, are positioned upon each of the three generally vertical chords of the platform single leg;

Figure 6:
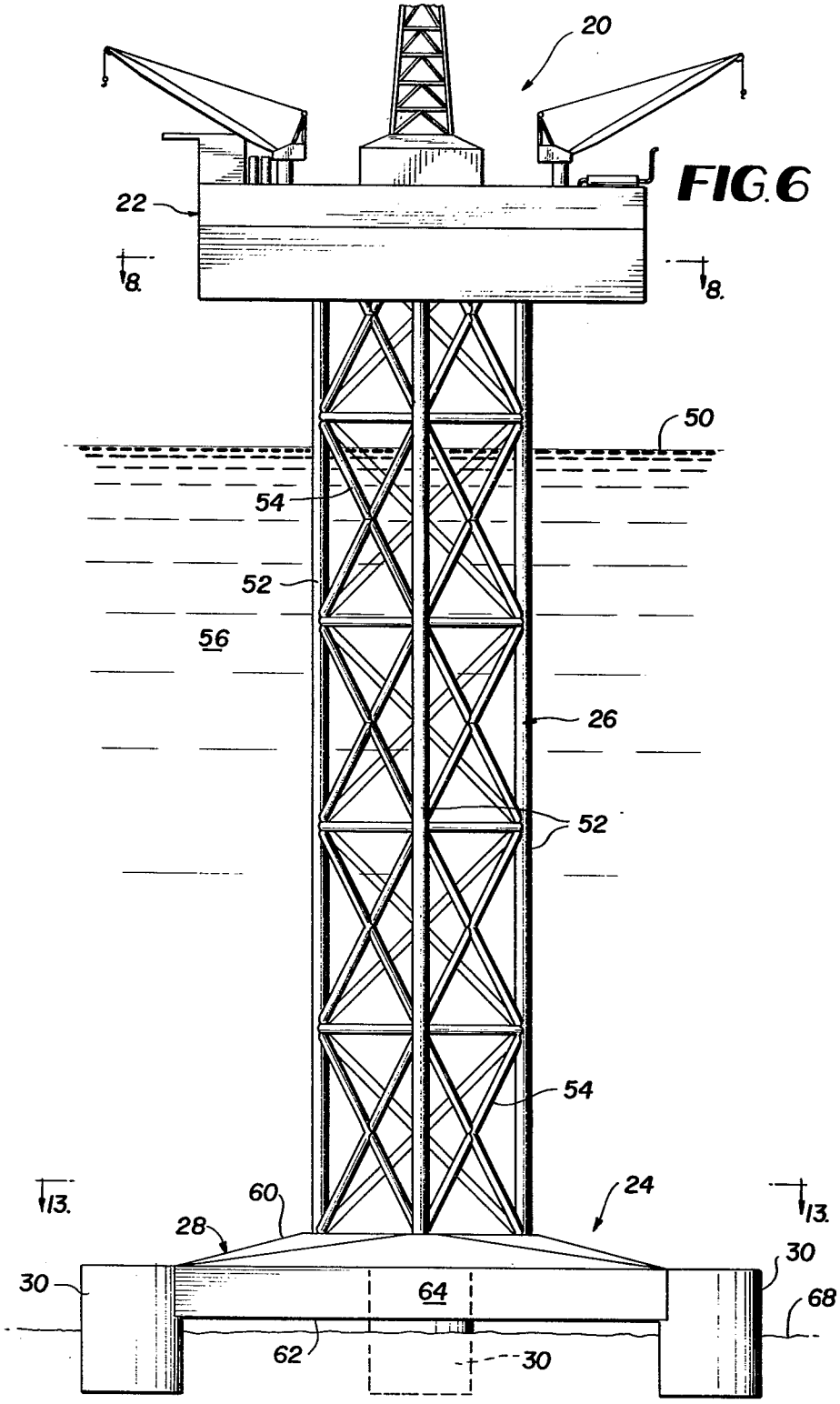
FIG. 6 is a sise elevational view of a preferred embodiment of the subject invention as depicted in FIG. 1.
Figure 15:
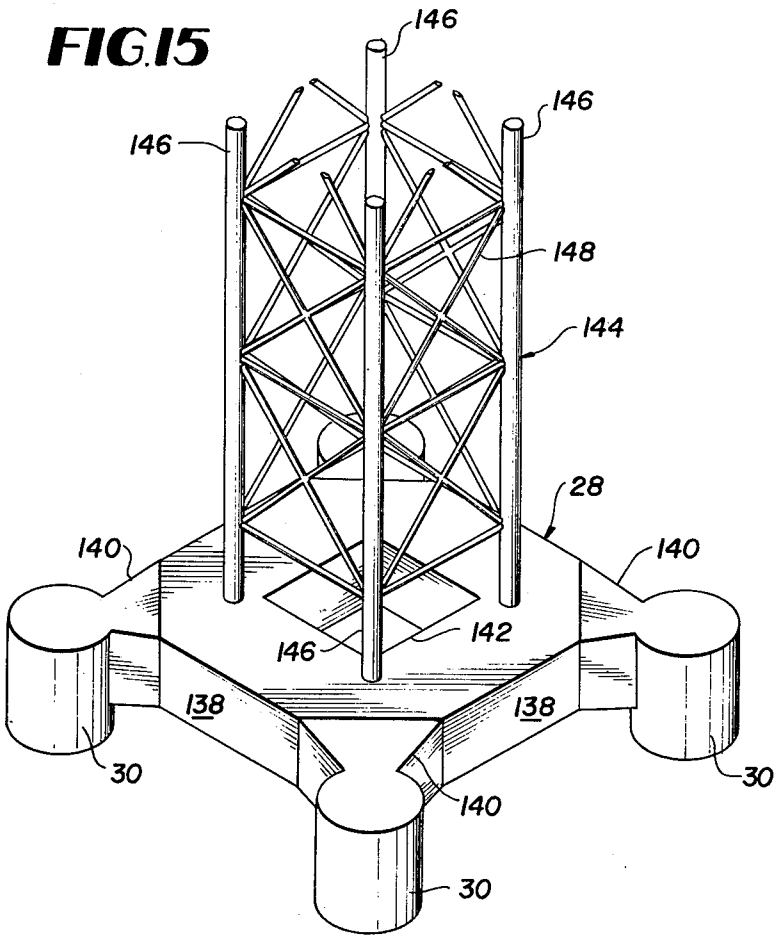
Figure 14:
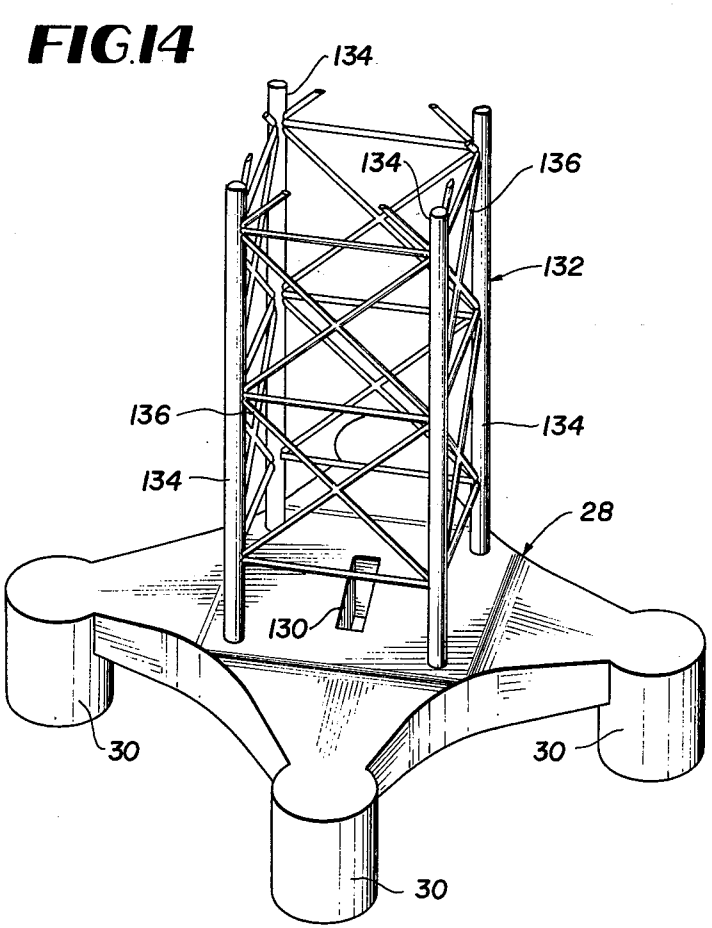

FIGS. 11*a–b* disclose a shematic jacking sequence for lowering a gravity base toward the bed of a body of water from a platform deck buoyantly supported upon the surface of the body of water;

FIGS. 12*a–b* disclose a schematic jacking sequence for raising the platform deck above the surface of the body of water following setting of the gravity base reaction members into the waterbed;

FIG. 13 is a plan view taken along section line 13—13 in FIG. 6 and discloses one preferred embodiment of a widespread, monolithic, gravity hull in accordance with the subject offshore platform;

FIG. 14 is an axonometic view of an alternative preferred embodiment of the subject invention wherein a generally quadrilateral shaped gravity hull is disclosed with inwardly directed curvilinear sides;

FIG. 15 is another view of a quadrilateral shaped gravity hull in accordance with the subject invention having a generally square configuration and an enlarged central window for permitting the passage of production strings from the platform deck; and FIGS. 16*a–d* disclose a preferred sequence of towing and instaling a single leg, gravity base, jack-up platform in accordance with the invention.

DETAILED DESCRIPTION

Figure 1:
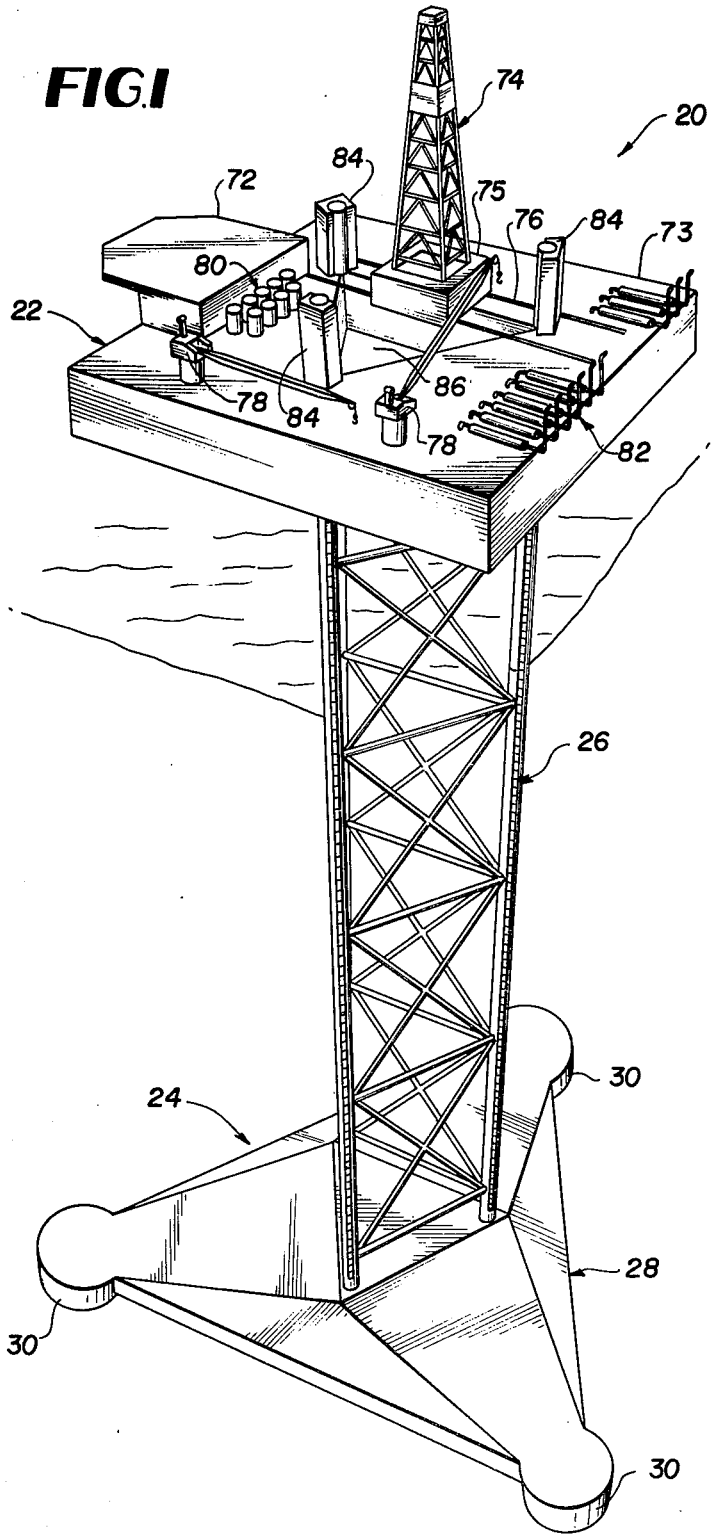
FIG. 1 is an axonometric view of a single leg, gravity base, jack-up platform for offshore drilling and/or production operations in accordance with a preferred embodiment of the invention.

Referring now to the drawings, and initially to FIG. 1, there will be seen an axonometric representation of an offshore drilling and/or production platform 20 in accordance with a preferred embodiment of the invention. In general terms the subject offshore platform comprises a deck 22, a gravity base 24 and an interconnecting single leg 26.

More specifically, the gravity base 24 comprises a generally polygonal shaped, (FIG. 1 depicts a triangular configuration) monolithic hull structure 28 with a plurality of reaction members 30 extending downwardly from the hull to penetrate a waterbed. The reaction members may assume a variety of polygonal cross-sectional configurations from triangular to circular. The longitudinal dimension and cross-sectional configuration of each reaction member 30 is of sufficient magnitude such that in combination the reaction members cooperate to maintain the offshore platform in an operative posture wherein the lower surface of the hull structure 28 is above and out of load bearing contact with the surface of the waterbed.

Context of the Invention

Before continuing with the detailed description of the subject platform it may be worthwhile to briefly outline the context of the instant invention. In this connection FIG. 2 schematically depicts a gravity base platform 32 having a flat, generally circular, gravity base 34 resting upon the bed 36 of a body of water.

Figure 2:
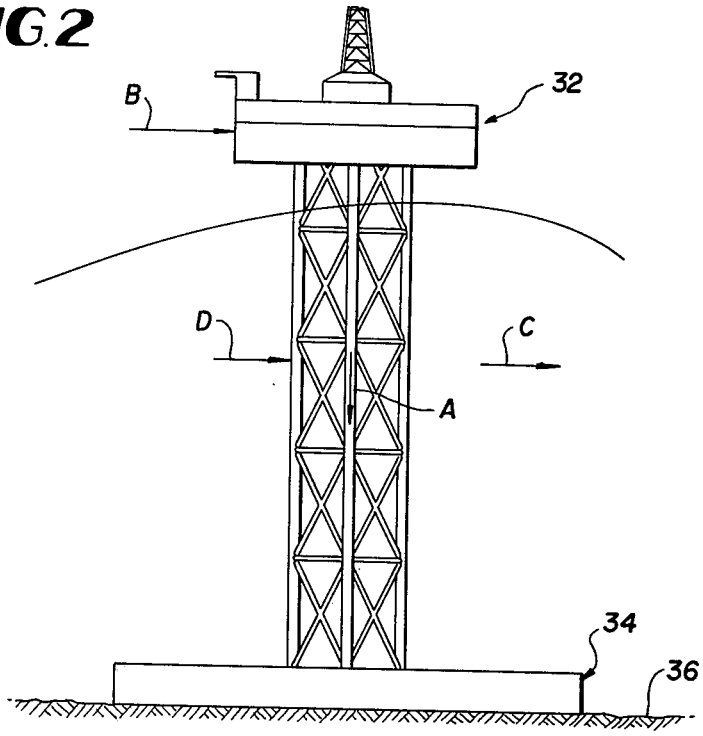
FIG. 2 is a schematic representation of a flat mat or gravity base offshore platform including directional arrows indicating vertical gravity forces and horizontal environmental forces imposed upon the offshore platform.
Figure 2:
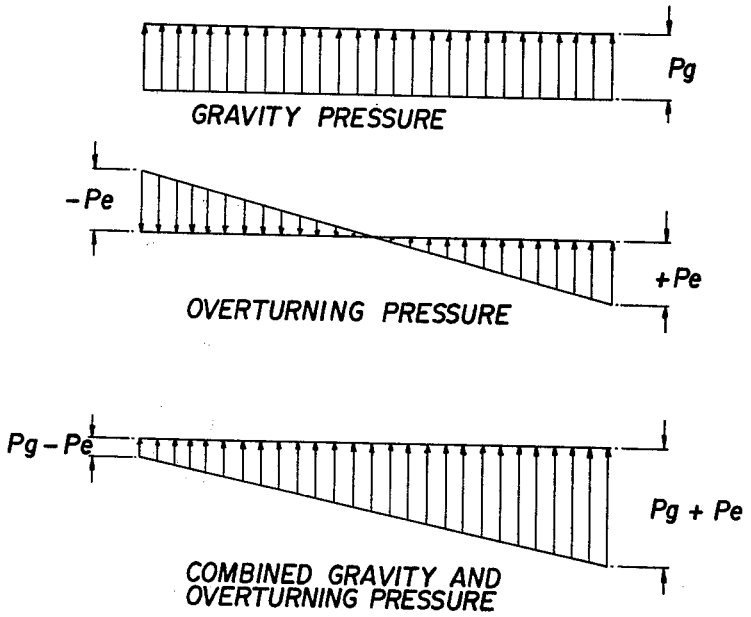

The type of loading experienced by a gravity base structure of this type is represented by directional arrows on FIG. 2. More specifically, the platform encounters: (1) vertical gravity loads A due to the weight of the structure, the equipment installed on the structure and operating supplies; and (2) generally horizontal loads due to wind B, wave C, and current D loading and possibly earthquakes. The horizontal forces, imposed by the environment, tend to slide the structure laterally and concomitantly create overturning moments.

The soil pressures resulting from these two types of loadings are depicted by force distribution diagrams at the lower portion of FIG. 2. The pressure shown as Pg is a result of the vertical gravity load A and is normally a uniform upward pressure that occurs over the entire base of the mat in contact with the waterbed. Soil loads imposed by laterally directed environmental forces B-D can be thought of as creating an uplift −Pe on the side of the platform facing the environmental loads and a downward load +Pe on the opposite side of the structure.

The total soil pressure is the resultant of the combined gravity loading and environmental loading. The maximum soil pressure is therefore Pg+Pe, while the minimum soil pressure is Pg−Pe. A properly designed mat will insure that Pg is always greater than Pe. In other words there should never be a design tendency for uplift to occur at the side of the mat facing the direction of environmental loading.

Unfortunately the foregoing design criteria typically dictates fabrication of a mat or gravity base with an extremely large diameter. The following example will serve to illustrate this point. As previously indicated no uplift occurs when:

$Pg \geqq Pe$, where $Pg = \frac{P}{A}$ ; and $Pe = \frac{Mc}{I}$ and where

-continued $P$ = total vertical load $A$ = area at base of flat base mat $M$ = environmental overturning moment $c = \frac{1}{2}$ diameter of the mat $I$ = moment of inertia of mat (geometrical property)

$= \frac{\pi D^4}{64}$ , where $D$ = diameter of mat

Assuming that an offshore platform has a vertical dead load of 46,500 Kips and an environmental overturning moment of $3.0 \times 10^6$ Kip-ft., D can be calculated, or by referring to points plotted on FIG. 3 can be read, to be approximately 500 feet at uplift equipoise.

Referring now to FIGS. 4 and 5 there will be seen a mathematical model for a quadrilateral mat 40 having reaction members 42 to penetrate a waterbed in accordance with the subject invention.

On the mathematical model 0-0 is assumed to be the overturning axis. No overturning or uplift will occur, as previously stated, when:

$Pg \geqq Pe$, where $Pg = \frac{P}{A}$ ; where:

$P$ = total vertical load $A = \frac{4\pi D^2}{4} = \pi D^2$, and $Pe = \frac{Ms}{Ioo}$ where:

$Ioo = 2\, ad^2 \times \frac{4D^4\pi}{64}$ , where $a$ = area of reaction member $d$ = distance from center of mat to center of reaction member $D$ = diameter of reaction member $M$ = Environmental overturning moment $S = d + D/2$ Assuming the same previously selected overturning and vertical dead loads of $3.0 \times 10^6$ Kip-ft. and 47,500 Kips respectively and a diameter of the reaction member to be 79 ft., the mat size can be calculated to have a side dimension "X" of 292 ft. This favorably compares with a 500 ft. diameter conventional mat needed to prevent an uplift situation from occuring.

In addition to the foregoing the nature of the environmental loading on the soil, i.e. horizontal load acting on the structure to cause an overturning moment, the soil loads are considered to be applied eccentrically. This has the adverse result that only a portion of the foundation effectively reacts to the environmental loads. The effective area is a function of eccentricity which is the ratio of the local soil restoring moment to the vertical load. In a simple flat continuous mat, the local restoring moment is equal to the total environmental overturning moment, however, with the use of reaction members, the local soil moment is a fraction of the environmental overturning moment. As a result, for the simple flat continuous mat, only 68% of the soil foundation contact area is effective for the given case study, while the reaction member concept of the subject invention utilizes 99% of the foundation soil contact area.

Accordingly, one aspect of the subject invention comprises a single leg, gravity base, jack-up platform with reaction members on the lowermost surface of the gravity hull which members are dimensioned to maintain the hull above and out of operative bearing contact with the waterbed.

Platform Structure

Referring again to FIG. 1, and additionally to FIG. 6, the subject platform, as previously mentioned comprises a jack-up deck a gravity base 24 and a single leg 26. The platform is of the type wherein deck 22 operatively functions in a drilling or production mode at an elevation above the water surface 50 to minimize the tendency of ever being contacted even by the crest of a statistical storm wave.

In an installed condition the deck 22 is supported upon the single leg 26 composed of a plurality of generally vertical tubular chords 52 which serve as primary structural elements. The chords 52 are mutually interconnected and unified into a single, rigid leg by the provision of "X" or "K" type bracing 54 having coped ends welded to the chords in a conventional manner.

Although in FIGS. 1 and 6 three chords have been interconnected as a unit, additional chord arrangements are contemplated by the subject invention such as four or more vertical columns joined together into an integral unit by K or X type superstructure.

The single leg 26 extends from the deck 22 downward through the body of water 56 and is fixedly connected to a generally central location of the gravity base 24.

The gravity base 24 comprises a generally monolithic hull having an upper surface member 60 and a lower surface member 62 both of which have a generally polygonal configuration and a side wall 64 interconnecting the upper and lower members to form a gravity base hull. The gravity base 24 further comprises a plurality of generally cylindrical reaction members 30 connected generally at the vertices of the polygonal shaped hull. The reaction members 30 are dimensioned to penetrate the waterbed 68 to refusal at full statistical design loading of the platform.

The bottom of each reaction member may be provided with a generally vertically extending skirt to facilitate soil penetration and establish a stable footing for each reaction member. Additionally, each reaction member may be provided with a coaxial jet nozzle to facilitate withdrawal of the reaction member from a soil formation. Operable structures for the foregoing skirt and jet nozzle are known in the art and may, for example, be fabricated along the lines disclosed in U.S. Pat. No. 3,412,563 of common assignment with the subject application. The disclosure of this U.S. Pat. No. 3,412,563 is hereby incorporated by reference.

Figure 7:
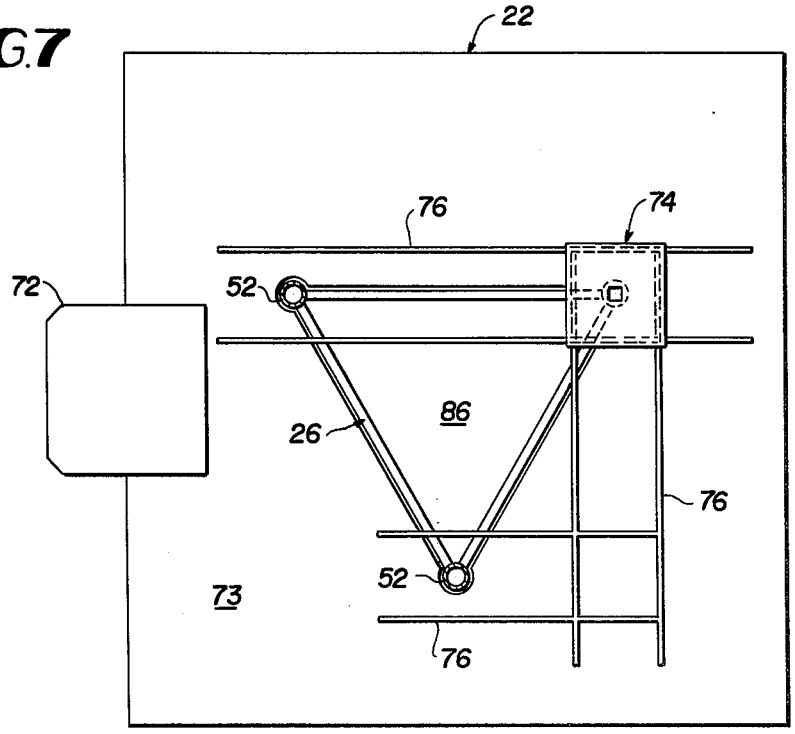
FIG. 7 is a schematic plan view of a deck portion of the offshore platform depicted in FIG. 1 including a skid rail system for supporting a derrick above generally vertical chords of a single triangular leg.

Referring now to FIGS. 1 and 7 there will be seen schematic views of a typical deck 22 in accordance with invention. In this regard the deck is fitted for normal offshore drilling and/or production activity, including crew quarters 70 and a heliport 72. The top surface 73 of the deck further carries a derrick 74 and a drawworks house 76 which rides upon skid frames 76 so that the derrick may be selectively stationed above each of the primary chords 52. Conductors may be installed within the chords and six or more wells may be drilled through each of the chords. Additionally and/or alternatively, skid rails may be provided to position the derrick at various well positions in the center of the leg for drilling and/or production. Further, the deck carries one or more general purpose cranes 78 and a plurality of mud, water and fuel tanks 80. A plurality of generators, pumps and compressors are also carried by the deck for providing electricity, pressurized slurries, hydraulic and compressed gas in accordance with conventional drilling techniques. FIG. 1 also depicts a bank of exhaust manifolds 82 which vent engines for the generators and compressors to the atmosphere. The foregoing description is intended to be illustrative and not exhaustive of typical deck equipment. Other equipment (not shown) such as pipe racks, mud labs and pits, bulk cement containers, etc. may also be included in the operational outfitting of the deck 22.

The deck 22 is provided with a jacking system including jack housings 84 operable to receive chords 52 and jack the deck 22 relative to the chords in a manner which will be discussed below. In order to achieve a raising or lowering of the deck, a central window 86 is fashioned through the deck 22 to permit vertical translation of the rigid leg 26 through the deck 22.

Figure 8:
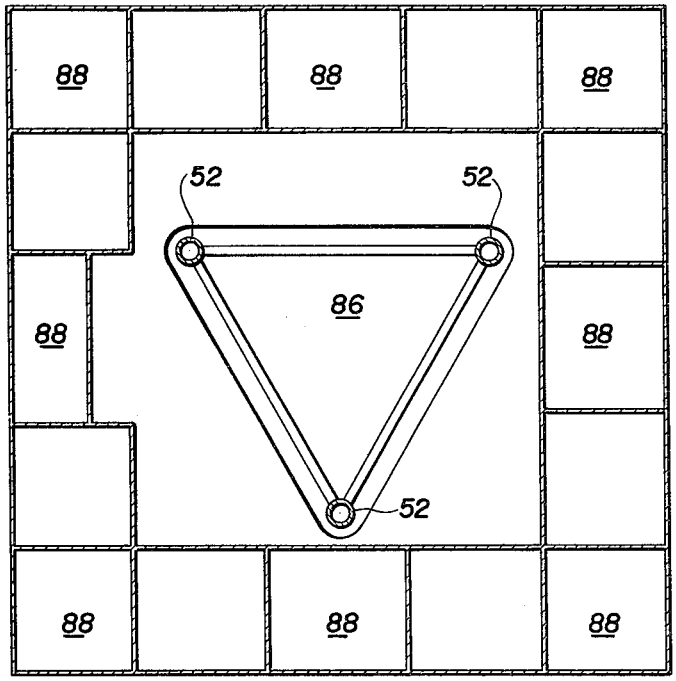
FIG. 8 is a cross-sectional view of the deck taken along section lines 8—8 in FIG. 6 and discloses buoyancy/ballast chambers within the interior of the platform deck.

FIG. 8 schematically depicts a cross-sectional view of a lower portion of the deck 22 taken along section line 8—8 in FIG. 6. This view discloses a plurality of peripherally stationed ballast/buoyancy chambers 88 positioned about the deck. Valves and piping interconnect these chambers with air compressors and water pumps so that the chambers may selectively take on ballast or eject ballast for reasons which will be discussed more fully below.

The spacing and location of the ballast/buoyancy chambers in FIG. 8 is illustrative and alternate arrangements may be utilized depending upon the location, weight and size of the drilling and/or production equipment carried by the platform.

As previously mentioned the deck 22 is selectively jacked up or down the single leg 26. The jacking system per se does not constitute a part of the subject invention and previously known devices may be utilized. One example of a jacking system which may be advantageously employed with the subject platform is disclosed in a U.S. Richardson Pat. No. 3,412,981 of common assignment with the subject invention. The disclosure of this Richardson U.S. Pat. No. 3,412,981 is hereby incorporated by reference as though set forth at length. Briefly, however, such a jacking system includes upper and lower semicircular collars 90 and 92, note FIG. 9, which are interconnected by a pair of vertically oriented hydraulic piston and cylinder assemblies 94 and 96. Each bit of the collars 90 and 92 in turn carries a piston and cylinder assembly 98 which serves to selectively engage aperatured rails 100 longitudinally welded along each chord 52 with reciprocating anchor pins 102–108.

As shown in FIG. 10, in operation, each chord 52 is fitted with a jacking assembly as discussed in reference to FIG. 9 and as disclosed in more detail in the Richardson patent.

Referring now to FIGS. 11*a* and 11*b* an operational sequence is shown depicting a situation where the gravity base 24 is being lowered or jacked down to the waterbed from the floating deck of the platform. In FIG. 11*a* the jack assembly rests upon the floor 109 of a jack housing. The chord 52 is in tension due to gravity upon the descending base 24. The hydraulic attachment pins 102 and 104 are withdrawn from engagement with the chord rails and the upper pins 106 and 108 carry the weight of the gravity base. In FIG. 11*b* pistons within the hydraulic cylinders 94 and 96 have been closed to permit the chord 52 to be lowered relative to the deck mounted jack housing. In the 11*b* position the horizontal hydraulic attachment pins 102 and 104 are engaged while corresponding pins 106 and 108 on the upper collar 90 are withdrawn to permit the collar to be extended upwardly by hydraulic assemblies 94 and 96 to again engage the chord 52. The process is repeated sequentially and the gravity hull is thereby jacked down to the waterbed stably supported from the floating deck 22.

Upon engagement of the gravity base 24 with the waterbed it is desirable to jack the deck into a posture above the water surface. In this regard FIGS. 12*a* and 12*b* disclose an operative sequence to raise the deck. FIG. 12*a* depicts pins 102 and 104 in engagement with the aperatured rail on chord 52. The upper lateral pins 106 and 108 are withdrawn and the upper collar 90 bears through a buffer against an upper surface 110 of the jack housing. The hydraulic piston and cylinder assemblies 94 and 96 are reacted against the now stationary chord 52 and the deck 22 is lifted vertically upward. The upper lateral pins 106 and 108 are then engaged with the chord, the lower pins 102 and 104 are retracted and the piston and cylinder assemblies 94 and 96 are retracted to a position such as depicted in FIG. 12*a*. The process is repeated until the deck is elevated to a desired position.

Turning now to the gravity base, FIG. 13 discloses one form of the base or mat 24 in accordance with the invention. In this regard the base comprises a hull 28 having upper and lower polygonal shaped surfaces 60 and 62 respectively and interconnecting side walls 64. The hull, thus formed, comprises an essentially hollow monolithic structure. A plurality of bulkhead 116 structurally rigidify the hull and divide the mat into a plurality of internal ballast/buoyancy chambers 118. Each of the chambers is fitted with conventional valving and air pressure, water and/or ballast lines to selectively ballast or deballast the mat as will be discussed below.

A plurality of reaction members 30 are connected to the mat as previously disclosed in FIGS. 1 and 6. These reaction members are generally cylindrical shells with closed top and bottom surfaces. Internally the reaction members 30 are constructed with reinforcing 120 which structurally rigidifies the reaction members 30 and ties the units into the gravity hull 28. The reaction member superstructure may take the form of bulkheads, as desired, to create a plurality of ballast/buoyancy chambers within the units. Again valving and air pressure, water and/or ballast lines (not shown) may be connected into the reaction members to selectively ballast and deballast the units.

Although the polygonal shape of the monolithic hull 28 in FIG. 13 is depicted as a triangle other higher polygonal configurations are contemplated by the invention. In this regard FIGS. 14 and 15 disclose variations of a gravity mat using a next order polygon, a quadrilateral.

The shape represented in FIG. 14 features inwardly directed gently curving sides and thus may be thought of as comprising a monolithic hull 28 having an inwardly directed, curvilinear, quadrilateral configuration. A window 130 is fabricated through the hull 28 and serves to permit production lines to be lowered through the interior of the rigid leg and through the mat for connection to a previously located well head template (not shown).

In addition to a quadrilateral monolithic hull the platform foundation features in FIG. 14 includes a rigid, single leg 132 composed of four upright chords 134 interconnected and operatively unified within an X-brace superstructure 136.

FIG. 15 depicts another embodiment of a quadrilateral base in accordance with the invention. In this embodiment the side walls 138 of the hull remain straight and cantilever extension arms 140 interconnect the monolithic hull 28 with the reaction members 30.

This embodiment also discloses a production window 142 extending through a central portion of the base as well as a single leg 144 composed of four chords 146 interconnected with an X-bracing superstructure 148.

In the embodiment depicted in FIG. 14 a line extending between nonadjacent reaction members is perpendicular to a side surface of the single leg 32. Alternatively the single leg may be advantageously rotated such said line between nonadjacent reaction members will intersect a central longitudinal axis of nonadjacent leg chords 146.

While FIGS. 13–15 have disclosed polygonal bases with three and four sides, polygons of higher order are contemplated by the invention such as pentagons, hexagons, heptagons, etc. up to and including a generally circular monolithic hull configuration.

The monolithic gravity hulls depicted in FIGS. 14 and 15, in a manner similar to the hull depicted in FIG. 13, are internally divided by a plurality of reinforcing bulkheads. These bulkheads serve to divide the quadrilateral mats into ballast/buoyancy chambers for selective flotation or ballasting of the platform.

Method of Installation

Referring now to FIGS. 16 *a–d* there will be seen a method sequence of transporting and installing a single leg, gravity base, jack-up offshore platform in accordance with the invention.

Figure 16A:
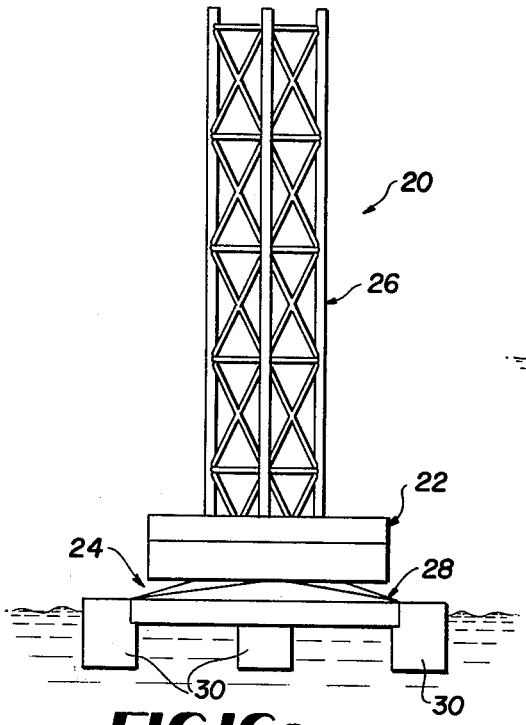

This method includes the initial steps of towing the platform 20 to a preselected offshore site in an assembled condition, note FIG. 16*a*. For this towing operation the single leg 26 is mounted upon the gravity base 24 and the deck 22 is jacked down to a posture adjacent the gravity base. The monolithic hull 28 and reaction members 30 have been deballasted and serve as a stable flotation structure for the deck 22 and single leg 26.

In the towing posture depicted in FIG. 16*a* it will be appreciated that the platform has a relatively low center of gravity and is quite stable. Accordingly, the deck may be substantially completed and fitted with drilling and/or productions equipment, supplies, etc. at a dock facility prior to the platform being towed to sea. This capability minimizes on site assembly operations which have heretofore been time consuming, somewhat hazardous and expensive. In the past it would not have been unusual to occasion substantial standby time and expense while waiting for a "weather window" to assemble the platform at sea.

Figure 16B:
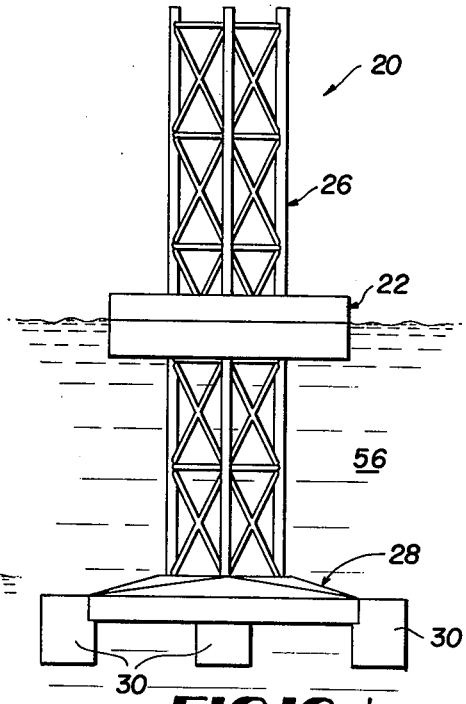

FIG. 16*b* depicts the platform during an initial setting stage at the offshore site. On station ballast is added to the hull 28 and reaction members 30 and the base 28 is jacked downwardly away from the deck 22. This jacking sequence has been previously described with reference to FIGS. 11*a* and 11*b*. During the jacking operation the platform is buoyantly supported by the deck 22. The large submerged mass, provided by the monolithic hull 28 and reaction members 30, hangs in a pendulum mode from the deck 22 which maintains a large water plane. Accordingly the platform is extremely stable during this jacking down operation.

This vertical stability provides a significant advantage when the base has been jacked downwardly to a position adjacent to but spaced above the waterbed and fine lateral positioning onto final station is desired.

Figure 16C:
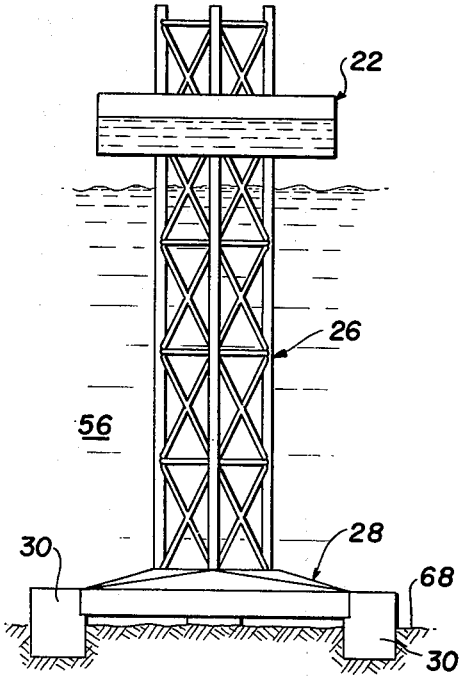

Once final positioning of the platform has been completed the reaction members 30 are jacked into engagement with the waterbed 68, note FIG. 16*c*. The deck 22 is then selectively ballasted. The amount and location of ballast added to the deck 22 is controlled to accurately penetrate the reaction members 30 into the waterbed to points of soil refusal to withstand full operational and statistical environmental loading conditions. Depending upon the soil conditions, size of the platform, diametrical size of the reaction members, etc. the reaction members may be penetrated to a depth of 30 feet or more. As clearly depicted in FIG. 16*c*, however, even upon full loading, the hull 18 is maintained above the surface of the waterbed and does not transmit vertical soil pressure Pg to the platform. Accordingly, the mass and lateral dimensions of the gravity mat may be reduced significantly over previously known designs as previously discussed in connection with FIGS. 2–5.

In some instances during the foregoing setting operation the hull 28 and reaction members 30 may merely take on seawater ballast. In other instances it is contemplated by the subject invention to add ballast with a high specific gravity to the hull and/or reaaction member chambers such as barite or bentonite. In these instances selective chambers 118 within the hull and/or reaction members may also be deballasted, if desired, and used as temporary oil storage containers.

Figure 16D:
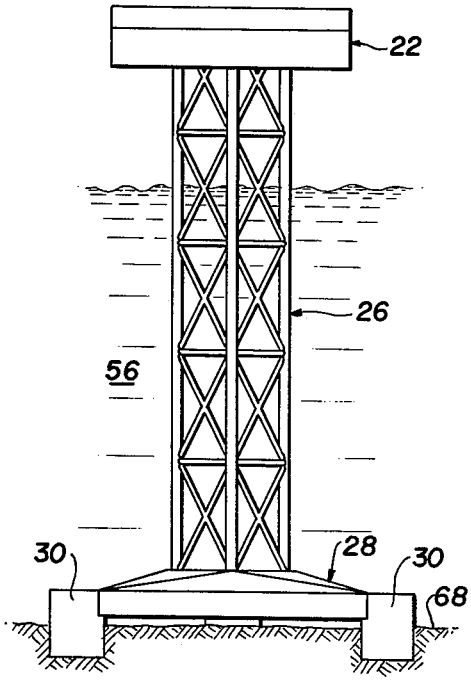

Referring now to FIG. 16*d* the platform is depicted in an installed condition where the reaction members 30 are fully set to refusal and the deck 22 has been deballasted and jacked upwardly to a height sufficient to be clear of a statistical storm wave crest for drilling and/or production operations.

SUMMARY OF MAJOR ADVANTAGES OF THE INVENTION

After reading and understanding the foregoing description of the invention, in conjunction with the drawings, it will be appreciated that several distinct advantages of the subject platform and method of towing and installation are obtained.

Without attempting to set forth all of the desirable features of the instant platform at least some of the major advantages of the invention include the unique combination of reaction members with a monolithic, gravity hull which permits the hull diameter and dead weight to be dramatically reduced while retaining platform resistance to environmental overturning moments. In this regard, unlike the case of flat mats, Pg is a function only of the sum of the areas of the individual reaction members and the environmental pressure Pe is primarily controlled by the spacing between the reaction members.

Additionally, the subject platform and method of installation insures stability of the platform during the setting operation because the deck acts to buoyantly support the platform with a large water plane. By the same token the stability of the platform during the jacking down process enhances the ability of the platform to be accurately positioned over a desired station. Stability of the subject platform during towing and setting synergistically permits attention to optimizing soil loading.

In a similar vein the subject combination of reaction members with a monolithic gravity hull maintains the advantages of a monolithic hull while increasing the efficiency of soil loading to prevent an uplift situation from occuring.

Additionally the subject monolithic hull, reaction members and deck may be constructed essentially in a completed form at a conventional dock or shipyard. Following construction the essentially completed platform may be stably towed to an offshore site floating upon the monolithic gravity hull.

On site the reaction members permit stationing of the platform at a location of uneven terrain and/or in areas where discontinuities in soil composition exist. Moreover, with prior gravity mats which were designed to rest upon the waterbed, washouts have occurred around drill holes and the like. Any tendency for washouts to occur is minimized by the subject reaction members which penetrate deeply into the waterbed.

Still further the subject reaction members in combination with the gravity base retain the advantages of a gravity base design while facilitating soil penetration capability during a setting operation.

While conventional gravity base towers, with large monolithic hulls, have an essentially fixed design the subject platform can be facilely retrofitted at a shipyard by altering the size, number and/or location or the reaction members to accomodate variant site conditions.

The subject platform and method also provides for relatively accurate penetration or setting by selectively taking on deck ballast. Additionally, the base or monolithic hull and the reaction members may take on ballast with a high specific gravity and in some instances the hull and/or reaction members may additionally be used to temporarily store oil within the platform.

Still further, the creation of a stiff, monolithic, gravity hull in combination with a stiff, unitized, single leg cooperate to provide a platform with a natural period of less than 5 seconds. The significant wave energy of the ocean typically ranges between 5 and 20 seconds. Accordingly, fatigue loading of the platform structural joints is minimized.

In describing the invention, reference has been made to preferred embodiments and illustrative advantages of the invention. Those skilled in the art, however, and familiar with the instant disclosure of the subject invention, may recognize additions, deletions, modification, substitutions and/or other changes which will fall within the purview of the subject invention and claims.

What is claimed is:

1. An offshore platform for flotation to an offshore site and installation in a posture supported upon the bed of the body of water, said offshore platform comprising:

deck means for supporting offshore operations and having a plurality of ballast/buoyancy chambers within the interior of said deck means;

gravity base means having lateral side walls and substantially continuous upper and lower polygonal shaped members connected to said lateral side walls for forming a generally monolithic gravity hull, said gravity hull having a plurality of internal ballast/buoyancy compartments whereby the gravity base may function in a flotation mode during movement of the platform from site to site and in a submerged ballast mode at a desired waterbed site adjacent to but operably spaced above and out of load bearing contact with the waterbed;

a plurality of reaction means downwardly extending from a plurality of generally peripheral locations of said gravity base means for engaging and penetrating into the bed of the body of water and reacting against vertical and lateral loads and overturning moments imposed upon said offshore platform;

leg means fixedly connected to said gravity base means and extending upwardly therefrom for connection to said deck means; and each of said reaction means having a longitudinal dimension and cross-sectional configuration of sufficient magnitude such that in combination said plurality of reaction means cooperate to maintain the offshore platform in an operative posture wherein the lower surface of said gravity hull is positioned adjacent to but operably spaced above and away from load bearing contact with the surface of the waterbed.

2. An offshore platform as defined in claim 1 and further comprising:

jack-up means interconnected between said deck means and said leg means for vertically translating said deck means with respect to said gravity base means upon said leg means.

3. An offshore platform as defined in claim 1 wherein: one of said plurality of reaction means is positioned generally at each of the vertices of said generally polygonal shaped, monolithic, gravity hull.

4. An offshore platform as defined in claim 1 wherein said leg means comprises:

a single leg having an integral structure of at least three tubular chord members extending generally vertically upward from said gravity base means, and a plurality of interconnecting brace means for mutually interconnecting said at least three chords into a single operative load bearing leg.

5. An offshore platform as defined in claim 4 wherein said at least three tubular chord members comprise:

a set of four chords positioned at the vertices of an imaginary square upon the upper surface of said gravity base means.

6. An offshore platform as defined in claim 1 wherein:

said generally monolithic hull is fabricated with a generally central window such that the platform may be positioned above an existing well template and producing strings may extend from said deck means through said generally monolithic hull for connection at the well template.

7. An offshore platform as defined in claim 1 wherein said generally polygonal shaped gravity base means comprises:

a generally triangular shaped, monolithic gravity hull.

8. An offshore platform as defined in claim 1 wherein said generally polygonal shaped gravity base means comprises:

a generally quadrilateral shaped, monolithic, gravity hull.

9. An offshore platform as defined in claims 8 wherein:

said quadrilateral shaped hull has a generally inwardly directed curvilinear quadrilateral configuration.

10. An offshore platform for flotation to an offshore site and installation in a posture supported upon the bed of the body of water, said offshore platform comprising:

deck means for supporting offshore operations and having a plurality of ballast/buoyancy chambers;

gravity base means comprising a generally monolithic, polygonal shaped, gravity hull, said gravity hull having a plurality of internal ballast/buoyancy compartments whereby the gravity base may function in a flotation mode during movement of the platform from site to site and in a submerged ballast mode at a desired waterbed site adjacent to but operably spaced above and out of load bearing contact with the waterbed;

a plurality of generally cylindrical reaction means downwardly extending from a plurality of generally peripheral locations of said gravity hull for engaging and penetrating into the bed of the body of water and reacting against vertical and lateral loads and overturning moments imposed upon said offshore platform, one of said plurality of reaction means being positioned generally at each of the vertices of said generally monolithic, polygonal shaped hull;

single leg means fixedly connected to a generally central portion of said gravity base means and extending upwardly therefrom to said deck means;

jacking means interconnected between said deck means and said single leg means for vertically translating said deck means with respect to said gravity base means upon said single leg means; and each of said generally cylindrical reaction means having a longitudinal dimension and cross-sectional configuration of sufficient magnitude such that in combination said plurality of reaction means cooperate to maintain the offshore platform in an operative posture wherein the bottom surface of said gravity hull is positioned adjacent to but operably spaced above and away from load bearing contact with the surface of the waterbed.

11. An offshore platform as defined in claim 10 wherein:

said polygonal shaped gravity hull has a triangular configuration; and said single leg means comprises an integral structure having three tubular chord members extending vertically upward from said gravity base means and a plurality of interconnecting brace means for mutually interconnecting said three vertical chords into a single operative load bearing leg.

12. An offshore platform as defined in claim 10 wherein:

said polygonal shaped gravity hull has a generally quadrilateral configuration; and said single leg means comprises an integral structure having four tubular chord members extending generally vertically upward from said gravity base means and a plurality of interconnecting brace means for mutually interconnecting said four vertical chords into a single operative load bearing leg.

13. An offshore platform as defined in claim 12 wherein:

said quadrilateral shaped hull has a generally inwardly directed curvilinear configuration.

14. A method for transporting and installing a gravity base, jack-up offshore platform comprising the steps of:

towing the platform, composed of a generally monolithic gravity base, with a plurality of downwardly extending reaction members, a deck, with a plurality of buoyancy/ballast chambers, and interconnecting leg means, to a preselected offshore site wherein the platform is buoyantly supported above the surface of the body of water by the gravity base and wherein the deck is mounted for towing adjacent to the gravity base and one end of the leg means is fixedly connected to the gravity base and extends generally vertically through the deck;

at a preselected waterbed site, at least partially ballasting the gravity base and buoyantly supporting the offshore tower from the surface of the body of water by said deck;

jacking the generally monolithic gravity base downwardly away from the floating deck toward the bed of the body of water;

jacking the generally monolithic gravity base onto the waterbed whereby the reaction members engage and penetrate into the waterbed;

adding ballast to the deck ballast chambers to penetrate the reaction members firmly into the waterbed to a depth sufficient to carry vertical and lateral loading and overturning moments imposed upon the offshore platform under working conditions while maintaining the bottom surface of the generally monolithic gravity base positioned adjacent to but operably spaced above and out of load bearing contact with the bed of the body of water;

ejecting ballast added to the deck ballast chambers previously added for facilitating the reaction member penetration operation; and jacking the deck up to an operational height above a predetermined wave crest level.

15. A method for transporting and installing a gravity base, jack-up offshore platform as defined in claim 14 and further comprising the step of:

laterally positioning the offshore platform above a preselected station while the platform is buoyantly supported at the water surface by said deck and the gravity base is suspended in a posture adjacent to, but vertically above, the waterbed.

16. A method for transporting and installing a gravity base, jack-up offshore platform as defined in claim 14 and further comprising the step of:

adding ballast, having a specific gravity greater than one, to internal chambers within the interior of said generally monolithic hull following said step of penetrating the waterbed with said gravity base reaction members.

* * * * *